US006509815B1

(12) United States Patent
Stolle

(10) Patent No.: US 6,509,815 B1
(45) Date of Patent: Jan. 21, 2003

(54) FEEDING OR DECOUPLING DEVICE FOR A COAXIAL LINE, ESPECIALLY FOR A MULTIPLE COAXIAL LINE

(75) Inventor: Manfred Stolle, Bad Aibling (DE)

(73) Assignee: Kathrein-Werks KG, Rosenheim (DE)

( * ) Notice: Subject to any disclaimer, the term of this patent is extended or adjusted under 35 U.S.C. 154(b) by 0 days.

(21) Appl. No.: 09/743,094

(22) PCT Filed: Apr. 27, 2000

(86) PCT No.: PCT/EP00/03839

§ 371 (c)(1),
(2), (4) Date: Jan. 5, 2001

(87) PCT Pub. No.: WO00/69015

PCT Pub. Date: Nov. 16, 2000

(30) Foreign Application Priority Data

May 6, 1999 (DE) ..... 199 20 980

(51) Int. Cl.[7] ..... H01P 1/00
(52) U.S. Cl. ..... 333/245; 343/791
(58) Field of Search ..... 333/245, 12, 124, 333/125; 343/790, 791

(56) References Cited

U.S. PATENT DOCUMENTS 3,945,013 A * 3/1976 Brunner et al. ..... 343/708
5,418,506 A * 5/1995 Mahnad ..... 333/134

FOREIGN PATENT DOCUMENTS

| | | |
|---|---|---|
| DE | 23 54 550 | 5/1975 |
| GB | 1 532 010 | 11/1978 |

* cited by examiner

*Primary Examiner*—Robert Pascal
*Assistant Examiner*—Kimberly E Glenn
(74) *Attorney, Agent, or Firm*—Nixon & Vanderhye P.C.

(57) ABSTRACT

A feed or output-coupling apparatus for coaxial lines has a spur line which is short-circuited at the end. In order, at least in the case of a single coaxial line, to allow a broadband connection of the inner conductor to the outer conductor, or at least in the case of a multiple coaxial line, to allow a corresponding short-circuiting connection between the inner conductor and outer conductor at least in a narrowband form, at least two interleaved coaxial spur lines are provided. Each spur line is short-circuited at their respective ends via a short-circuit with their lengths being dimensioned such that the associated short-circuit at the feed and connecting point is transformed to an open circuit, depending on the respectively appropriate frequency band range.

18 Claims, 5 Drawing Sheets

FEEDING OR DECOUPLING DEVICE FOR A COAXIAL LINE, ESPECIALLY FOR A MULTIPLE COAXIAL LINE

BACKGROUND OF THE INVENTION

1. Field of the Invention

The invention relates to a feed or output-coupling device for a coaxial line, in particular a multiple coaxial line.

2. Background of Related Art

A problem which arises in many applications is to connect the inner conductor of a coaxial line to the same potential as the outer conductor, in general to earth. In practice, this can be done, for example, by means of a short-circuited $\lambda/4$ spur line, which is connected in parallel with another line. Thus, in other words, the inner conductor is short-circuited to the outer conductor at the end of the spur line. Although the inner conductor is electrically connected to the outer conductor by connecting the short-circuited $\lambda/4$ spur line in parallel, this parallel circuit does not change the input impedance of the other line if, specifically, the length of the coaxial line is one quarter of the relevant wavelength. Specifically, the short-circuit at the end of the spur line is transformed to an open circuit at the input to the line. This principle is thus dependent on the wavelength and thus to this extent acts only over a narrow bandwidth.

Such circuits may be used, for example, as surge arresters (lightning protection circuits) in coaxial lines in order to connect an inner conductor to the potential of the outer conductor for narrowband applications, that is to say, as a rule, to connect the inner conductor to earth, in the same way as the outer conductor, and thus to earth it.

In fact, a large number of operational situations are known—which will also be described in the following text—in which the narrowband solution mentioned above is inadequate. Specifically, a large number of operational situations require a broadband solution. As a rule, this necessitates the use of gas-filled surge arresters.

One other important operational case of a broadband application relates to the mobile radio area.

As is known, the majority of the mobile radio area is handled via the GSM 900 network, that is to say in the 900 MHz band. In addition, GSM 1800 Standard has become established, inter alia, in Europe, in which signals can be received and transmitted in an 1800 MHz band.

Multiband antenna devices for transmitting and receiving various frequency band ranges are therefore required for such communication, and these antenna devices normally have dipole structures, that is to say one dipole antenna device for transmitting and receiving the 900 MHz band range, and a further dipole antenna device for transmitting and receiving the 1800 MHz band range.

To this extent, there is also a requirement for omnidirectional antennas with two separately fed antenna systems, in which case each antenna system is intended to be suitable for at least two frequency bands. Depending on the requirement, the individual antenna systems can then be connected or used for one or two frequency band ranges. The implementation of this concept means that, for example, two such multiband antennas are installed alongside one another, although this is linked to the disadvantage that the individual antennas no longer have an omnidirectional polar diagram, since their radiation fields shadow one another. Furthermore, such a concept requires a relatively large amount of space, particularly if at least approximately omnidirectional transmission characteristics are intended to be achieved.

In contrast to the concept mentioned above, it is also in principle known for two corresponding antenna devices to be arranged one above the other. However, this concept can be implemented only if the individual antenna systems are intended for only one frequency band range. The feed and output-coupling apparatus in this case comprises two coaxial cables, which are each routed out of the antenna mast at the level of the relevant antenna device.

A feed or output-coupling apparatus for a coaxial line for a multiband antenna is known, in principle, from DE 23 54 550 A1, with this previously known arrangement comprising an outer conductor and an inner conductor together with a spur line, which is in each case connected to the outer conductor and the inner conductor of a feed line at the side. The outer conductor is short-circuited to the inner conductor at the end of the spur line. The length of the spur line in this case corresponds to one quarter of the wavelength of the waves which pass via the feed line.

In principle, it would be desirable to provide an antenna device which comprises a number of antenna systems arranged one above the other and which should then, in fact, likewise be useable for at least two frequency band ranges. However, multiband or broadband feeding is impossible in this case with known means and solutions.

However, applications which are even simpler than this are also conceivable, in which, for example, a multiple antenna system is operated in only one frequency band range, although no suitable feed or output-coupling apparatus which is easy to handle is known for this purpose.

BRIEF SUMMARY OF THE INVENTION

The object of the invention is thus to provide an improved feed or output-coupling apparatus, in particular for a single-band or multiple frequency band antenna device.

The invention for the first time provides a solution for connecting an inner conductor to the potential of the outer conductor using simple means, to be precise for broadband application, that is to say an application having at least two frequencies or frequency band ranges. In this case, the inner conductor can be connected to earth in the same way as the outer conductor. The concept according to the invention can be extended without any problems to multiple coaxial lines, by means of which it is then possible, according to the invention, to feed multiple, multiband antenna systems, arranged one above the other, without any problems.

The concept according to the invention consists in that two interleaved, short-circuited $\lambda/4$ lines or spur lines are used, for example, for two frequency bands, with the electrical length of the one line being matched to the one frequency, and the electrical length of the other short-circuited line being matched to the other frequency. Since the two short-circuited $\lambda/4$ lines are connected in series, the short-circuits at the feed point result in an open circuit being transformed for each of the two frequency band ranges, as a result of which the outer coaxial line can be fed in a matched manner. The short-circuiting connection in this case results in the inner conductor being connected to the same potential as the outer conductor, so that the inner conductor is connected to earth when the outer conductor is also connected to earth.

For one preferred embodiment, the electrical length of the outer $\lambda/4$ line corresponds to the higher frequency, with the electrical length of the inner coaxial line being matched to the lower frequency. An opposite arrangement is equally possible.

The principle according to the invention can, however, be implemented equally well for even greater bandwidths in that, for example, appropriate matching is also provided for at least one further frequency band range, that is say, for example, a third frequency band range which is offset from the first two frequency bands. In this case, the inner conductor is electrically connected to the outer conductor by three short-circuited λ/4 lines (spur lines) which are interleaved with respect to one another, with the electrical length of the three short-circuited spur lines being matched to the relevant frequency bands.

One particularly preferred embodiment provides for the inner conductor of the coaxial line to be formed by a further coaxial line, thus resulting, for example, in a triax line. The inner coaxial line may be used, for example, to feed an upper antenna system which covers at least two frequency band ranges, in which case the outer coaxial line can be used to feed a lower antenna system with at least two frequency band ranges in a corresponding manner. The outer conductor of the inner coaxial line is in this case at the same time the inner conductor of the outer coaxial line, which is connected to the same potential by the short-circuited and interleaved λ/4 lines according to the invention.

If a multiple coaxial line having a number of inner and outer conductors is intended to be fed in a general form, then the principle according to the invention is used in cascaded form, using short-circuiting lines which are interleaved with respect to one another and are provided as a function of the number of frequencies, in order in this way to electrically connect a respective outer conductor to the closest inner conductor on the inside in each stage.

The principle according to the invention makes it possible, without any problems, to feed and to provide output coupling for a number of individual antennas via a common line even, for example, for the case of a multiband, or at least two-band antenna without any problems. This line comprises a multiple coaxial line, for example a triax line when there are two antenna devices arranged one above the other. If the aim is to feed n antennas arranged one above the other, then a coaxial line with n+1 lines is required. In this case, each of the antenna devices arranged one above the other can be used to transmit or receive a number of frequency band ranges, for example two frequency band ranges, three frequency band ranges, etc.

A multiband output-coupling apparatus according to the invention for such multiple coaxial lines allows very good output coupling for the various frequency band ranges to be transmitted, for example for the two bands at 900 MHz and 1800 MHz in the mobile radio area. The good matching which this results in leads to a considerably improved VSWR (voltage standing wave ratio, that is to say to an improved ripple factor or standing-wave ratio).

BRIEF DESCRIPTION OF THE DRAWINGS

The invention will be described in the following text particularly with reference to a two-band range antenna having two antenna devices arranged one above the other. In this case, in detail.

DETAILED DESCRIPTION OF EXEMPLARY EMBODIMENTS OF THE INVENTION

Figure 1:
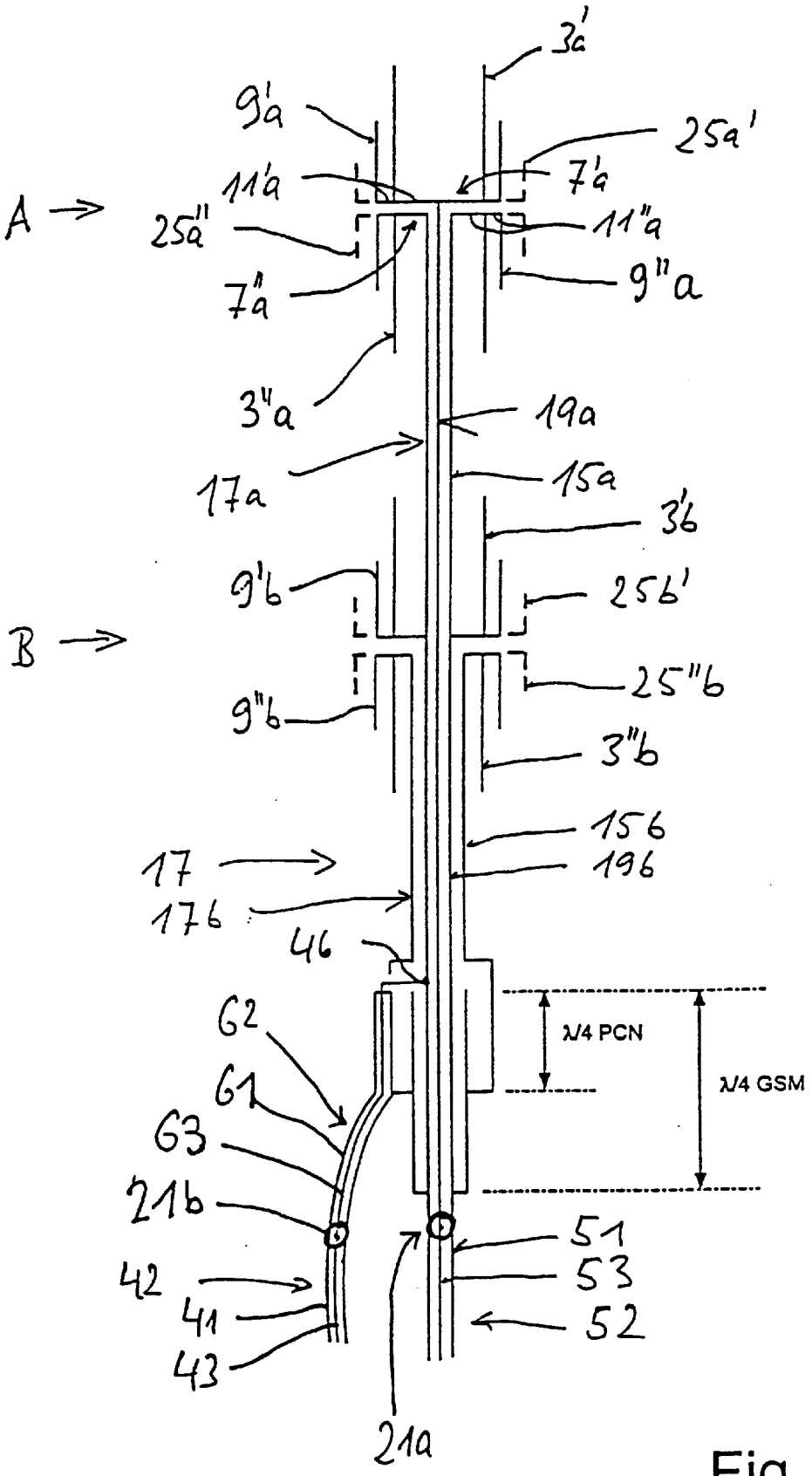
FIG. 1 shows a schematic axial longitudinal cross section through an exemplary embodiment of two two-band antennas arranged one above the other.

A multiband antenna as shown in FIG. 1 comprises a first antenna device A having two dipole halves 3'*a* and 3"*a* which, in the illustrated exemplary embodiment, are formed from an electrically conductive cylindrical tube. That dipole half 3'*a* which is at the top in the figure is in this case in the form of a sleeve, that is to say it is closed in the form of a sleeve at its dipole end 7'*a* adjacent to the second dipole half 3"*a*.

The length of these dipole halves 3'*a* and 3"*a* depends on the frequency band range to be transmitted and, in the illustrated exemplary embodiment, is matched to the transmission of the lower GSM band range, that is to say, in accordance with GSM mobile radio standard, to transmission of the 900 MHz band.

A second antenna in the form of a dipole is provided for transmitting a second frequency band range, 1800 MHz in the illustrated exemplary embodiment, and its dipole halves 9'*a* and 9"*a* are designed with a shorter length corresponding to the higher frequency band range to be transmitted, being only approximately half as long as the dipole halves 3'*a* and 3"*a* in the illustrated exemplary embodiment, since the transmission frequency is twice as high.

These dipole halves 9'*a* and 9"*a* are likewise tubular or cylindrical in the illustrated exemplary embodiment, but have a larger diameter than the diameter of the dipole halves 3'*a* and 3"*a*, so that the dipole halves of the antenna 9*a* with the shorter length can accommodate and engage around the dipole halves 3'*a* and 3"*a* which have the greater longitudinal extent and are located on the inside.

The dipole halves 3'*a* and 9'*a*, together with 3"*a* and 9"*a*, which are in each case interleaved in one another, and are each located at the mutually adjacent inner ends 7'*a* and 7"*a* of the dipole halves, are all in the form of sleeves and are thus electrically connected to one another forming a short-circuit 11'*a* and 11"*a*, respectively.

The drawing also shows that the lower dipole halves 3"*a* and 9"*a* are fed via an outer conductor 15*a* of a coaxial feed line 17*a*, with the inner conductor 19*a* being continued beyond the short-circuit 11"*a* at the end 7"*a* of the lower dipole half as far as the short-circuiting connections 11'*a*, which are in the form of sleeves, of the upper dipole halves 3'*a* and 9'*a*, where they are electrically and mechanically connected to the bases, which are in the form of sleeves, of these dipole halves 3'*a* and 9'*a*.

With this configuration, it is possible to feed both the dipole antennas 3*a* and 9*a*, which are arranged interleaved in one another, via a single coaxial connection 21*a*, to which a coaxial connecting line 52 having an outer conductor 51 and an inner conductor 53 is fitted, and the feed line 17, originating from this, and having the outer conductor 15*a* and the inner conductor 19*a*.

The antenna operates in such a way that the dipole halves which are intended for the higher frequency band range and with the shorter longitudinal extent act as radiating elements to the outside, while the inside of these dipole halves 9'*a* and 9"*a*, which are in the form of sleeves, act as a detuning sleeve, however. This detuning sleeve effect ensures that no surface waves can propagate to the dipole halves of the second antenna, which are provided with the greater longitudinal extent.

However, the detuning sleeve for the higher frequency of the outer dipole halves 9'*a*, 9"*a*, which are in the form of tubes or sleeves, is not "identifiable" or effective for the second antenna 3*a* with the dipole halves 3'*a*, 3"*a* which intrinsically extend over a greater length, so that these dipole halves also act as individual radiating elements towards the outside. The inside of the lower dipole half 3"*a*, which is in the form of a sleeve, acts as a detuning sleeve, however. This detuning sleeve effect ensures that no surface waves can propagate on the outer conductor 15*a* of the coaxial feed line 17*a*.

This configuration results in an extremely compact antenna arrangement, which also has an optimum omnidirectional radiation characteristic which has not previously been known; and all this with simplified feeding via only a single, common connection.

However, in contrast to the illustrated exemplary embodiment, the dipole halves need not necessarily be tubular or in the form of sleeves. Polygonal (n-polygonal) or else any other dipole halves which do not have a circular shape, for example dipole halves with an oval shape, may also be used instead of a round cross section for the dipole halves 3'*a* to 9"*a*. Furthermore, the dipole halves may also be composed of structures in which the circumferential outer surface is not necessarily closed but is broken down into a number of individual elements which are curved in three dimensions or are even planar, provided they are electrically connected to one another at their mutually adjacent 7'*a* and 7"*a*, respectively, dipole halves on which the short-circuit 11'*a* or 11"*a*, respectively, in the form of a sleeve and as mentioned above, is formed, and, at the same time, are designed such that the said blocking effect between the respective outer sleeve and the inner sleeve is maintained, in order to ensure that no surface waves can propagate.

The dashed lines in the exemplary embodiment illustrated in the attached FIG. 1 indicate that this design principle can be extended without any problems to other frequency band ranges. The dashed lines in this case indicate that, for example, a further outer sleeve could also be provided for dipole halves 25'*a* and 25"*a* of a third antenna 25*a*, which further outer sleeve is designed for an even higher frequency and therefore has an even shorter longitudinal extent. Once again, these dipole halves 25'*a* and 25"*a* are each short-circuited, at their mutually facing inner end 7'*a* and 7"*a*, to the corresponding end of the other dipole halves. The outside of these dipole halves 25'*a* and 25"*a* acts as a radiating element for this frequency, with the inside acting as detuning sleeves for the closest inner dipole halves. However, these detuning sleeves once again have no effect for those dipole halves which are interleaved on the inside.

Alternatively, the antenna device shown in FIG. 1 comprises a second multiband antenna device B which, fundamentally, is constructed in the same way, in which case the letter suffix "b" in the reference symbols is used for this second antenna device B, rather than "a", as is used for the first multiband antenna device A.

In an antenna such as this, as shown in FIG. 1, it is desirable if the upper multiband antenna device A could be fed, for example, via a triple coaxial line 17, that is to say via the inner coaxial line 17*a* with the inner conductor 19*a* and the outer conductor 15*a*, and if the lower antenna device B could be fed via the outer coaxial line 17*b* with the inner conductor 19*b* and the outer conductor 15*b*. Thus, in this case, the central coaxial conductor has two functions since, firstly, it is the outer conductor 15*a* for the upper antenna device A and, at the same time, it is the inner conductor 19*b* for the lower antenna device B. However, since the outer conductor 15*a* of the inner coaxial line is connected to earth (for example by the coaxial connecting connection 21*a*), and this outer conductor 15*a* of the inner coaxial cable 17*a* at the same time represents the inner conductor 19*b* of the outer coaxial cable 17*b*, this means that the inner and outer conductors 19*b*, 15*b* of the outer coaxial cable 17*b* are at the same potential, namely earth.

Additional technical measures are thus required to allow a corresponding feed for operation of the upper and lower antenna devices A and B, respectively, and, furthermore, to allow an inner conductor to be connected to the same potential as the outer conductor.

Figure 2:
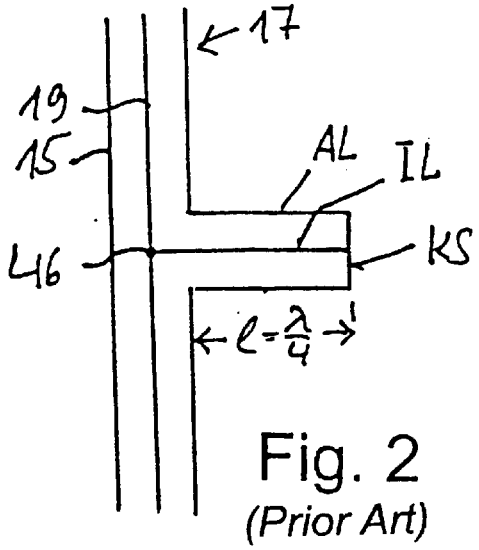
Fig. 2 (Prior Art)
FIG. 2 shows a narrowband lightning protection device, which is known from the prior art, for a coaxial line.

A solution which is known from the prior art for a coaxial line 17 with an inner conductor 19 and an outer conductor 15 is shown in FIG. 2, which coaxial line 17 has, at a connecting point 46, a coaxial spur line SL whose coaxial outer conductor AL is electrically connected to the outer conductor 15 of the coaxial line 17, and whose inner conductor IL is electrically connected to the inner conductor 19 of this coaxial line 17. At the end of the spur line, the outer conductor AL is short-circuited to the associated inner conductor IL via a short-circuit KS in the form of a sleeve, via which the inner conductor 19 is thus connected to the outer conductor 15 of the coaxial line 17. This is done for a specific frequency or a specific frequency band in such a way that the electrical length of the coaxial spur line SL1 corresponds to $\lambda/4$, where $\lambda$ is the wavelength of the relevant frequency or relevant frequency band. However, this can only ever be done over a narrow bandwidth for a specific frequency, and thus for a specific wavelength.

Figure 3:
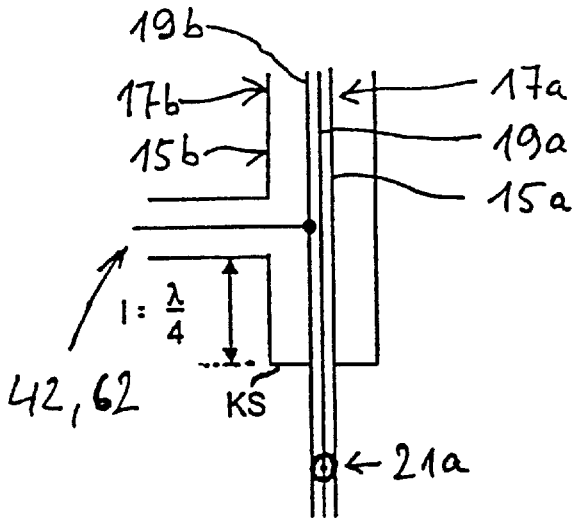
FIG. 3 shows a section of a schematic axial sectional illustration to explain a principle of a feed and output-coupling apparatus according to the invention for feeding a triax line for one frequency band.

If the antenna described in FIG. 1 and having an upper and a lower antenna device is intended to be operated in only one frequency band, then this can be done via a common multiple coaxial line with a feed or output-coupling apparatus according to the invention, as shown in FIG. 3.

The exemplary embodiment shown in FIG. 3 differs from that in FIG. 2, inter alia, in that the coaxial line 17 makes a right-angled bend at the connecting point 46, that is to say, coming from above, it does not continue downward as shown in FIG. 2, but continues to the left from the connecting point 46. In the exemplary embodiment shown in FIG. 3, the spur line shown in FIG. 2 is shown as an axial extension of the coaxial connecting line running vertically upward above the connecting point 46. A further difference is that the inner conductor 19 shown in FIG. 2 is replaced by a coaxial line 17*a* in FIG. 3.

An electrical connection for the inner conductor 19*a* or the outer conductor 15*a* of the inner coaxial line 17*a* for feeding the upper antenna device A can now be produced via a coaxial cable 52 which leads to a coaxial connection 21*a* and has an inner conductor 53 and an outer conductor 51, with the outer coaxial line 17*b* being fed in a corresponding manner, via a second feed line 42 with an inner conductor 43 and an outer conductor 41, and via a coaxial connection 21*b* and a coaxial intermediate line 62 with an inner conductor 63 and an outer conductor 61, for which purpose, finally, the inner conductor 63 of the second connecting line 42 is electrically connected at the connecting point 46 to the inner conductor 19*b*, and the outer conductor 41 is electrically connected at the connecting point 46 to the outer conductor 15*b* of the feed line 17*b*. Thus, in electrical terms, the intermediate line 62 represents the outer coaxial feed line 17*b* with the inner conductor 19*b* and the outer conductor 15*b*. If, as in this exemplary embodiment, the upper and lower antenna devices A and B, respectively, shown in FIG. 1, are operated in only one frequency band range, then the feed is connected to the connecting point 46 in such a way that the length 1 of the coaxial spur line SL, or of the associated outer conductor AL, is $1=\lambda/4$ for the frequency under discussion. The short-circuit KS in the form of a sleeve, by which means the outer outer conductor 15*b* is electrically short-circuited to the inner outer conductor 15*a*, results in a transformation to an open circuit at the connecting point 46. Thus, for operation in one frequency band, the appropriate antenna device can be fed using the feed or output-coupling apparatus explained with reference to FIG. 3.

Figure 4:
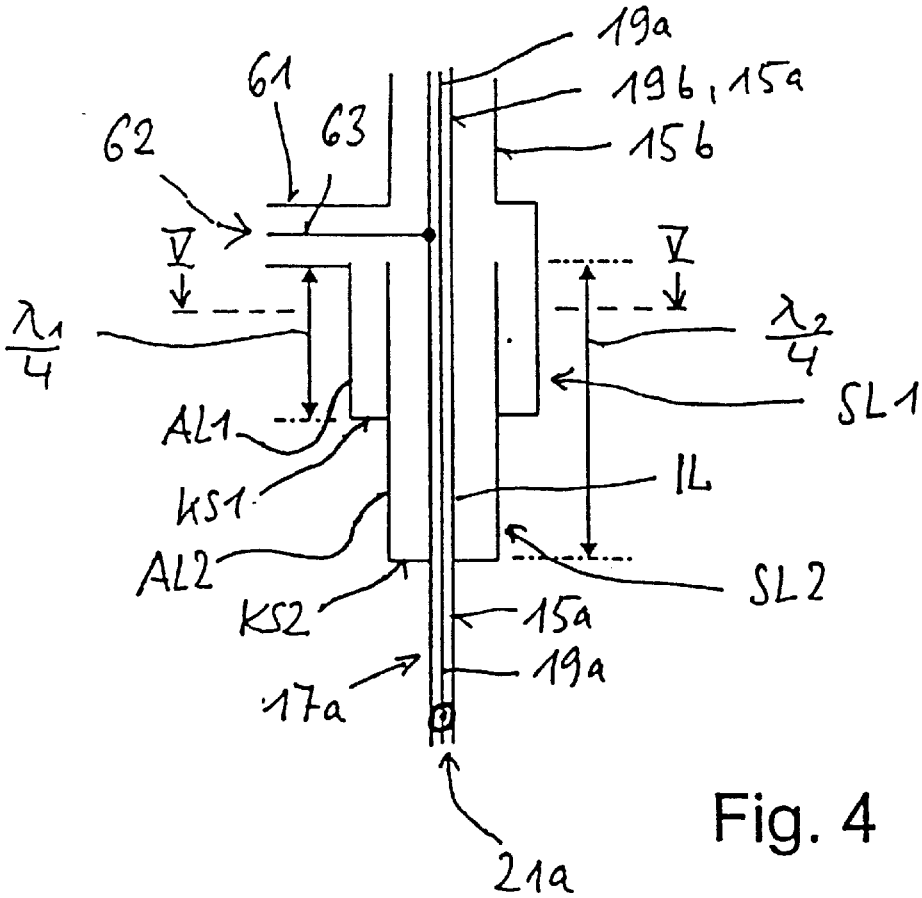
FIG. 4 shows a development according to the invention of a multiband feed or output-coupling apparatus.
Figure 5:
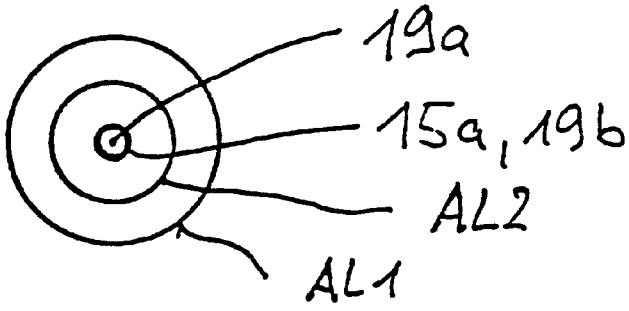
FIG. 5 shows a schematic cross-sectional illustration along the line V—V in FIG. 4.

However, in contrast, if the antenna described in FIG. 1 and having two antenna devices A and B arranged one above the other is intended to be operated in two frequency band ranges, then a feed or output-coupling apparatus as explained in FIG. 4 is required, and this will be described in the following text.

By way of example, if the antenna device shown in FIG. 1 is to be operated in two different frequency band ranges, two coaxial $\lambda/4$ lines, which are respectively short-circuited via a short-circuit KS1 or KS2, are interleaved, with the outer $\lambda_1/4$ line SL1 being used for matching for the higher frequency (for example for transmission of the 1800 MHz frequency band range, for example PCN), and the inner $\lambda_2/4$ line SL2 being used for matching for the lower frequency, for example the 900 MHz band (for example GSM). In consequence, the outer conductor AL1 of the first spur line SL1 is short-circuited at the end of the spur line (with respect to the feed point 46) by means of a radial short-circuit KS1, that is to say a short-circuit which is annular or in the form of a sleeve, to the outer conductor AL2 of the coaxial spur line SL2, and the outer conductor AL2 of the spur line SL2 is in turn short-circuited via a further radial short-circuit KS2, that is to say a short-circuit which is annular or in the form of a sleeve, to the inner conductor 19*b* of the outer coaxial line. The inner outer conductor AL2 ends freely adjacent to the connecting point 46.

Thus, according to the exemplary embodiment, the upper antenna device A is fed via a first coaxial cable connection 21*a*, with the inner conductor 53 merging into the inner conductor 19*a*, and the outer conductor 51 of the connecting line 52 merging into the outer conductor 15*a* of the coaxial feed line 17*a* for the upper antenna device A.

The lower antenna device B is fed via a second coaxial cable connection 21*b* and *a* downstream intermediate line 42 with an associated outer conductor 41 and an inner conductor 43, in such a way that the inner conductor 43 is electrically connected to the inner conductor 19*b* of the coaxial feed line 17, and the outer conductor 41 of the second coaxial cable connecting line is electrically connected to the outer conductor 15*b* of the triax line. In this case, the desired matching is carried out at the lower end of the feed and output-coupling apparatus, by means of the spur lines SL1, SL2 which are interleaved in coaxial form and are each short-circuited at their end, as a function of the wavelength $\lambda_1/4$ and $\lambda_2/4$ for the two frequency bands to be transmitted, with the first short-circuiting line KS1, which is in the form of a sleeve, being located approximately in the axial center with respect to the electrical length of the coaxial spur line SL2 and being matched to the frequency band range of 900 MHz and 1800 MHz to be transmitted in this exemplary embodiment.

The two short-circuited $\lambda/4$ spur lines SL1 and SL2 which have been explained are thus connected in series such that the associated short-circuits KS1 and KS2 are each transformed to an open circuit for the respective frequency band range at the connecting point 46.

Figure 6:
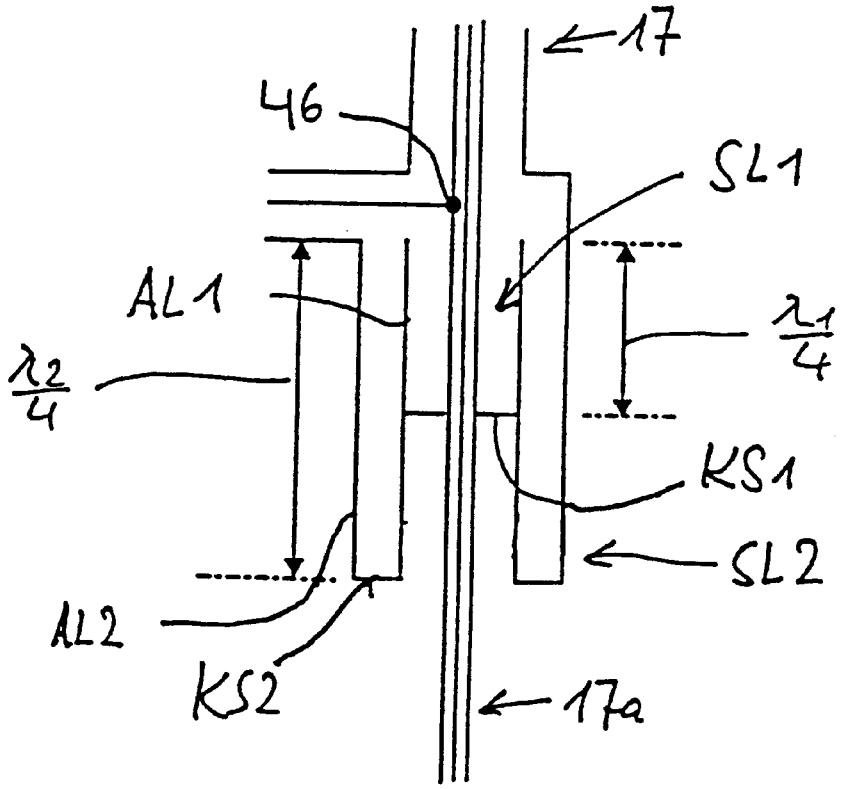
FIG. 6 shows an exemplary embodiment modified from that in FIG. 4.

FIG. 6 shows that the design principle of the series-connected short-circuiting lines KS1 and KS2 can also be implemented in the opposite sequence, specifically, if the $\lambda_2/4$ spur line SL2 (with the outer conductor AL2) for the lower frequency is arranged on the outside, and the $\lambda_1/4$ spur line SL1 (with the outer conductor AL1) for the higher frequency is arranged on the inside (concentrically) of the first spur line. However, the design complexity for this is somewhat greater.

In addition to the exemplary embodiments explained above, a number of short-circuited $\lambda/4$ lines, for example three, can also be interleaved in one another, thus allowing a number of frequency band ranges (for example three frequency bands) to be fed in and output.

Figure 7:
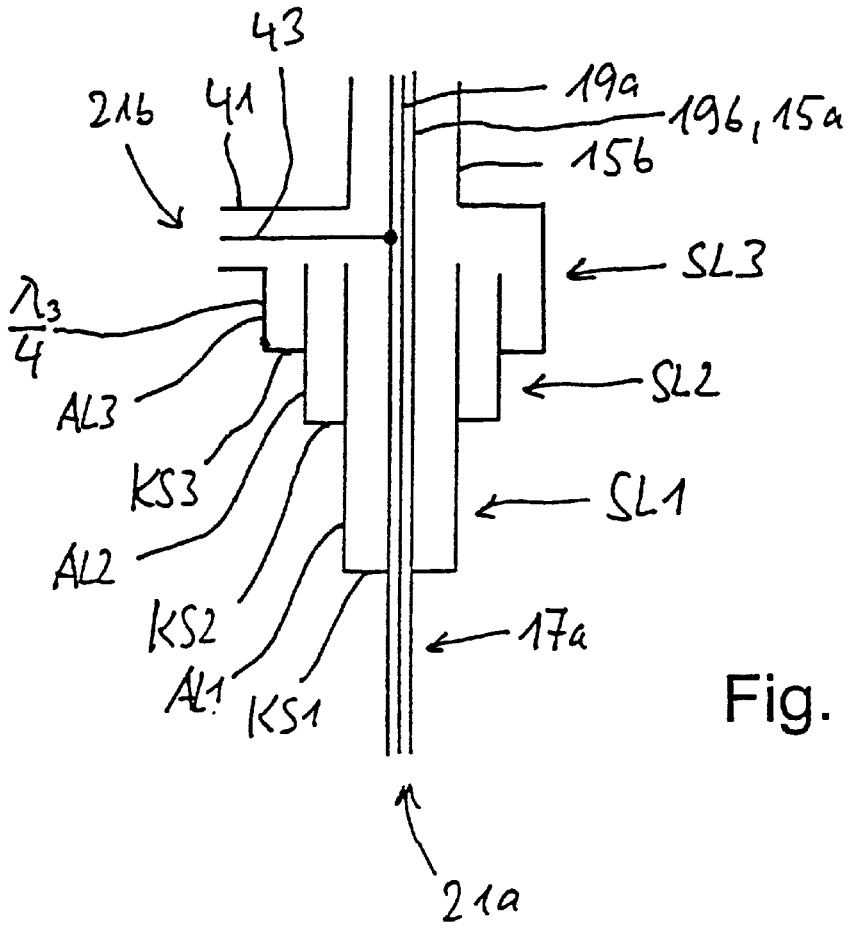
FIG. 7 shows an exemplary embodiment once again modified from that in FIG. 4, for a multiband output-coupling apparatus for feeding three frequencies (three frequency bands) which are transmitted or received via two antenna devices.

FIG. 7 shows only the design principle for the situation where it is intended to feed three frequency bands, offset with respect to one another, into a corresponding multiple coaxial feed line 17, for which purpose a third short-circuiting connection KS3 is provided for matching, with the assumption being made in this exemplary embodiment that the third short-circuit KS3 has a length $\lambda_3/4$ for transmission of an even higher frequency band range.

Figure 8:
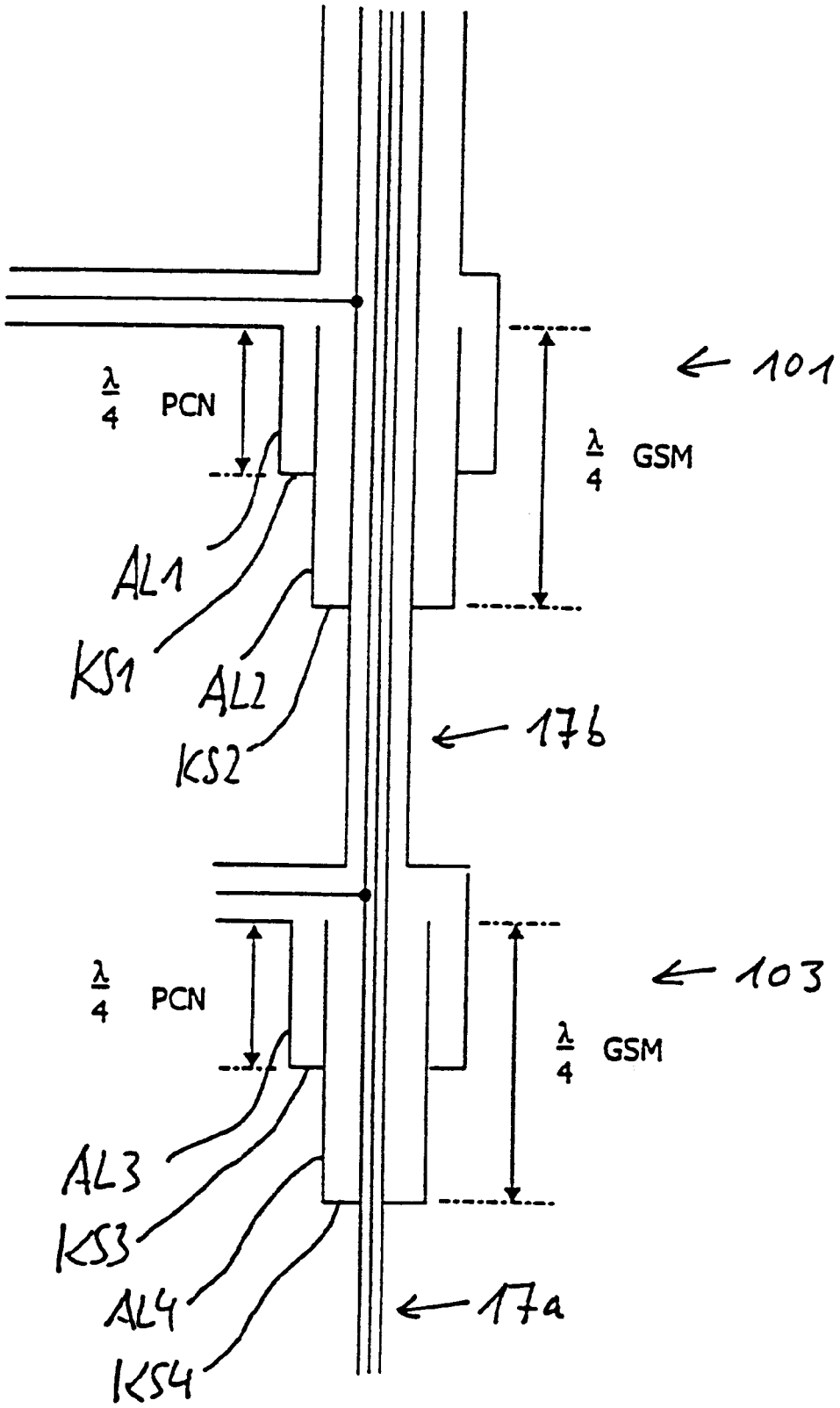
FIG. 8 shows an exemplary embodiment which has been developed further in comparison to FIG. 4, for feeding three antenna devices, which are arranged one above the other and cover two frequency band ranges, by means of a quadruple coaxial line.

FIG. 8 shows an exemplary embodiment of a feed or output-coupling apparatus which is modified once again in comparison to FIG. 4 and in which, for example, in addition to the exemplary embodiment shown in FIG. 1, three antenna devices which are arranged one above the other can be jointly fed via one multiple coaxial cable line 17, with said antenna devices operating in two frequency band ranges. There, appropriate matching between an outer outer conductor and an associated inner conductor is in each case shown in cascaded form via two feed and output-coupling apparatuses as explained with reference to FIG. 4, in which case this associated inner conductor at the same time represents the outer conductor for the closest inner inner conductor. In each of the stages envisaged, an outer conductor with its associated inner conductor is in each case connected to a common potential via the described feed or output-coupling apparatus 101 or 103, respectively, according to the invention. The exemplary embodiment in FIG. 8 shows how this method as well can be extended into a number of stages with further outer conductors AL1, AL2 and short-circuits KS3, KS4.

Figure 9:
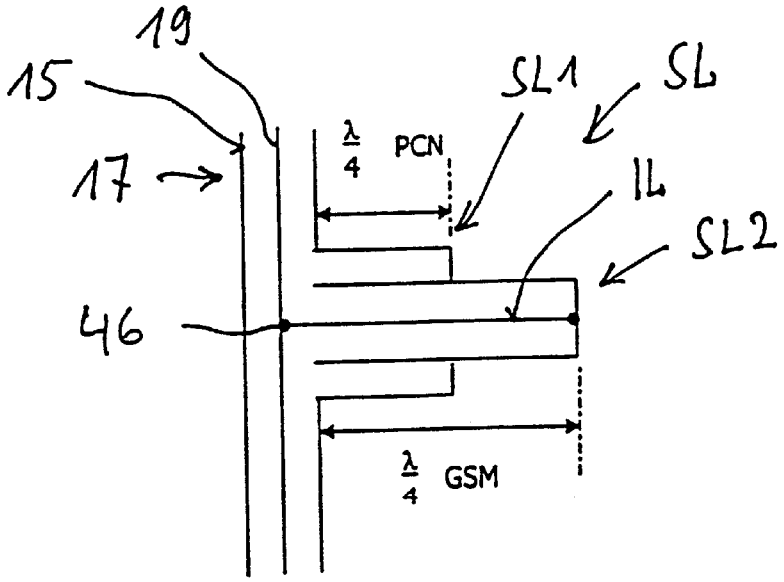
FIG. 9 shows an embodiment comparable to that in FIG. 4 but with only a single inner conductor (for example as lightning protection for a two frequency band device).

FIG. 9 shows another feed and output-coupling apparatus for a single coaxial line 17, but which is provided with broadband lightning protection, in the illustrated exemplary embodiment for two frequency band ranges.

Operation in this case corresponds to that for the exemplary embodiment shown in FIG. 4, although, in contrast to this, only a single inner conductor 15 is provided instead of the inner coaxial conductor 17*a* shown in FIG. 4, so that this inner conductor is passed through running in the axial direction without any curvature, and the two interleaved spur lines SL1 and SL2, which are once again short-circuited at the end, branch off at right angles from this coaxial line 17. With regard to the design and method of operation, reference is otherwise made to the exemplary embodiment shown in FIG. 4 which, with regard to the outer coaxial conductor 17*b* and the outer conductor 15*b* and the inner conductor 19*b*, shown in FIG. 4, can be transferred analogously to the exemplary embodiment shown in FIG. 9.

What is claimed is:

1. Feed or output-coupling apparatus for multiple coaxial lines for multiband antennas, the apparatus comprising:

at least one coaxial feed line, a spur line which branches off from the coaxial feed line, the spur line comprises at least two interleaved coaxial spur lines, wherein an electrical length of an outer coaxial spur line corresponds to $\lambda_1/4$, where $\lambda_1$ corresponds to a wavelength of a first frequency band range and is matched to it, an electrical length of an inner coaxial spur line corresponds to $\lambda_2/4$, where $\lambda_2$ corresponds to a wavelength of a second frequency band range and is matched to it, an outer conductor of the outer coaxial spur line is short-circuited at its end via a first short-circuit to an outer conductor of the inner coaxial spur line, the outer conductor of the inner coaxial spur line is connected at its end via a second short-circuit to an inner conductor of this inner coaxial spur line, the outer conductor of the outer coaxial spur line is connected to an outer conductor of the coaxial feed line, the inner conductor of the inner coaxial spur line is electrically connected at a connecting point to an inner conductor of the coaxial feed line, and the feed or output-coupling apparatus is matched for at least two frequencies or frequency band ranges.

2. Feed or output-coupling apparatus according to claim 1, wherein the at least two interleaved spur lines run away transversely from the at least one coaxial feed line, and the coaxial feed line is routed via the connecting point in an axial extension beyond the connecting point.

3. Feed or output-coupling apparatus according to claim 1, the coaxial feed line comprises at least one triax line, with the inner conductor of the inner coaxial spur line being in the form of a coaxial feed line which passes through the second short circuit between the outer conductor of the inner coaxial spur line and the associated inner conductor of the inner coaxial spur line.

4. Feed or output-coupling apparatus according to claim 3, wherein an inner feed line is formed such that it runs away in a straight line via the connecting point to which an inner conductor of a second feed line is connected.

5. Feed or output-coupling apparatus according to claim 3 wherein the outer conductor of the outer coaxial spur line is electrically connected to the outer conductor of an outer coaxial feed line, and the inner conductor of the inner coaxial spur line, which at the same time forms an outer conductor of an inner feed line, is electrically connected at the connecting point to an inner conductor of an outer feed line.

6. Feed or output-coupling apparatus according to claim 1, wherein the first and second short-circuits of the spur lines are in the form of sleeves or rings.

7. Feed or output-coupling apparatus according to claim 1, wherein the first short circuit for a higher frequency band range is located on the outside, and engages coaxially around the second short circuit, whose axial length is greater than it, for a lower frequency band range to be transmitted.

8. Feed or output-coupling apparatus according to claim 1, wherein the first short circuit for a higher frequency band range is located on the inside, and is coaxially surrounded by the second short circuit, whose axial length is greater than it, for a lower frequency band range to be transmitted.

9. Feed or output-coupling apparatus according to claim 1, wherein the first and second short circuits, which are in the form of sleeves and run radially, are offset in the longitudinal direction of the coaxial feed line.

10. Feed or output-coupling apparatus according to claim 1, wherein at least one inner coaxial line, having an inner and an outer conductor, passes through the feed or output-coupling apparatus, and at least one further coaxial outer conductor, which surrounds this inner coaxial line, has an outlet opening, with an inner conductor of a second coaxial feed line being passed through this outlet opening to the connecting point on the inner conductor of the coaxial feed lines.

11. Feed or output-coupling apparatus according to claim 1, wherein one or more inner conductors and one or more outer conductors of a multiple coaxial line can be connected to a same potential via the feed or output-coupling apparatus.

12. Feed or output-coupling apparatus according to claim 11, wherein an electrical connection between at least one of the inner conductors and at least one of the outer conductors is in a broadband form and is thus produced for at least two frequency band ranges.

13. Feed or output-coupling apparatus according to claim 11, wherein the same potential is earth.

14. Feed or output-coupling apparatus according to claim 1, wherein the length of the at least two spur lines which are interleaved with one another have electrical lengths depending on the frequency band ranges to be transmitted, the second short-circuit which is provided at the respective end of the inner coaxial spur line is transformed to an open circuit at the connecting point.

15. Feed or output-coupling apparatus according to claim 1, wherein for operation of multiple antenna devices which operate in one frequency band, the apparatus is connected to these devices.

16. Feed or output-coupling apparatus according to claim 1, wherein the feed or output-coupling apparatus is connected to an antenna device which operates in at least two frequency band ranges.

17. Feed or output-coupling apparatus according to claim 16, wherein the antenna device is an antenna system having at least two antenna devices which are located one above the other and transmit in at least two frequency band ranges.

18. Feed or output-coupling apparatus according to claim 1, wherein the feed and output-coupling apparatus is matched over a broadband width for at least two frequencies or frequency band ranges.

* * * * *